US008016461B2

(12) United States Patent
Bextermiller Metzger

(10) Patent No.: US 8,016,461 B2
(45) Date of Patent: Sep. 13, 2011

(54) LAMP LITE

(76) Inventor: Theresa Marie Bextermiller Metzger, Saint Loius, MO (US)

( * ) Notice: Subject to any disclaimer, the term of this patent is extended or adjusted under 35 U.S.C. 154(b) by 446 days.

(21) Appl. No.: 11/585,323

(22) Filed: Oct. 24, 2006

(65) Prior Publication Data

US 2008/0151552 A1 Jun. 26, 2008

(51) Int. Cl.
*F21S 13/00* (2006.01)

(52) U.S. Cl. ..... 362/367; 362/157; 362/185; 362/362; 362/162

(58) Field of Classification Search ..... 362/121, 362/124, 157, 162, 182, 185, 362, 363, 367, 362/806, 807, 808; 206/745, 748, 759, 573; 229/116.1, 117.01, 117.08, 930, 931; 40/541–607.15
See application file for complete search history.

(56) References Cited

U.S. PATENT DOCUMENTS

| | | | | |
|---|---|---|---|---|
| 1,760,767 | A * | 5/1930 | Muller | 40/541 |
| 4,253,135 | A * | 2/1981 | Black | 362/249 |
| 4,532,579 | A * | 7/1985 | Merryman | 362/239 |
| 7,080,927 | B2 * | 7/2006 | Feuerborn et al. | 362/368 |
| 2003/0142499 | A1 * | 7/2003 | Chiu | 362/368 |

* cited by examiner

*Primary Examiner* — David V Bruce
*Assistant Examiner* — Danielle Allen

(57) ABSTRACT

Metal ornamental body for a hanging (ceiling) light (single white light bulb) fixture consists of three possible units, from simple to complex: single (in red, R), double (in green, G), corner (in blue, B), with a more complex unit(s) possible. The three lightweight materials, of metal, wire and/or plastic, are all derived from six modular pieces that slot and/or join together with lightweight metal or plastic rods. These inexpensive units can be grouped, are portable and disposeable. Designed, used and installed per current National Electrical Code, lamp light bulb socket/wire/wall plug assembly is packaged separately, and/or sold with/without accessories separately. Packages, posters, postcard, logos, light units and all designs and colors are with the digital world in mind: R 255+G 255+B 255=white light.

3 Claims, 1 Drawing Sheet

Legend:
Fig. 1 is for a Single Unit, and is Piece 1
Fig. 2 is for a Double Unit, and is Pieces 1 and 2
Fig. 3 is for a Corner Unit, and is Pieces 1, 2 and 3
Fig. 4 is for a Single Unit, and is Pieces 4 and 5
Fig. 5 is for a Double Unit, and is Pieces 4 and 6
Fig. 6 is for a Corner Unit, and is Pieces 3, 4 and 6

LAMP LITE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The present invention relates generally to the field of simple, affordable hanging light fixture bodies, useful by and for anyone. Because of the importance being gained by computers in everyday life, concentration is on a modular design comprised of a few parts. Many people do not understand the complexity of computers, and, so, concentration was put on designing a utilitarian light body that showed understanding of the computer. Lighting around computers, while the computers are being used, is still being studied. Computer placement; wiring and electrical outlet placement; seating and desk design and placement are room design factors, and thus other subjects, but the design of light fixtures seems to be still very simple and traditional. The parts of standard light fixture assemblies are covered under a few, known, patented designs.

This item can be crafted by hand in a few hours, so a pattern can be sold separately. This light body design was originally designed in 1989 in New York City.

A need for simple understanding of computer usage existed in 1989, and, since, there has been seen little desktop or spot lighting used in computer labs. Recessed, from a hung ceiling, overhead lighting, and fluorescent lighting as opposed to incandescent lighting, is used, and preferred now. Because of marketing of fluorescent bulbs as energy saving, there has been an interest from the public, and this has been reflected in 2009 sales of fluorescent bulbs.

Because 'white light' is becoming more prevalent, there existed and exists a market for a safe, metal enclosure for the everyday, common, 40 watt or smaller possible, white incandescent light bulb, and subcategories. 'White light' can be understood as white fluorescent light, or lack of color on TV and computer monitors. 'Lack of color' on televisions can be thought of as 'snow', or lack of clear picture. Lack of clear picture or lack of any picture on a television can be a bright white light. Perhaps, one can think of grouping small televisions around a computer monitor on a desktop, and turning the screens all to 'snow'. That would be a moveable, simple, affordable, craftable light, that anyone could design. But, the body is the television, a different product than only a simple, single, light fixture body. A television is a pre-assembled box of a pre-manufactured material—all one has to do is plug in the set and there is light. Like U.S. Pat. No. 7,080,927, a television is modular, is of a small geometric size, and is comprised of small digits or bytes on the screen. A computer, also, displays small digits, or bytes, of color. To enlarge or to emphasis the small 'bytes' in a lamp design is what U.S. Pat. No. 7,080,927 had in mind, or modular lighting with blocks. This present invention does not have that concept in mind.

The concept of this invention is white light, and, especially, to emphasize where white light comes from today. White light comes from a protected light bulb. There are no variations, to a great deal, in the modular design of the light bodies. Circles, squares and triangles hang three-dimensionally around a white light bulb, making sure the bulb could not be harmed, or others harmed, when used as a hanging light body. Many light fixture design assemblies are comprised of four sides around a cubic volume. The cubic volume equals so many square inches around a light bulb or several light bulbs. This invention is not that—there is no predefined cubic volume or negative space around a light bulb. The circles, squares, and triangles are not comprised of a heavy material, and could be thought of as a negative material, or, more specifically, the minimum amount of material. Positive material is the light bulb and the light socket and the cord. Anyone could hang a light bulb and a socket with a cord, plug in the cord and have a moveable, simple, affordable, craftable light. There exists 'cages' in light fixtures that are used outdoors, in wet areas, in industrial areas, and in permanent locations. These 'cage' designs are prevalent in buildings, easily recognizeable from structure to structure. They are so prevalent that they could be called a form of 'lamp blocks'.

This 'cage' enclosure, on a table lamp, is called the 'shade'. Shades are removable and interchangeable from table lamp to table lamp. Shades are made of plastic, and can be covered with fabric. They can, also, be glass, or metal, on rare occasions. Glass or metal shades can be included in traditional cylindrical table lamps, and are seen in floor lamps. The present design is for a single, or multiple, hanging light fixture body for a light bulb, variable in size, scale, that will be shining down from a higher place, and will be placed near a ceiling; or in a corner of a room midway down; or above a dining table, above seated above eye level. The light fixture body is not permanent, and is not designed to be a permanent part of the architecture. Say that the light fixture body is disposable, or has the life expectancy of a light bulb. There needs to be some light fixture bodies included on the same shelves with light bulbs in the stores. This temporary ornamental light fixture body emphasizes the white light coming from the bulb. Light bulbs are thought to be affordable, and the fixtures are thought to be permanent installations in housing and commercial buildings. This invention throws those thoughts out and puts forth the idea that light fixtures can be temporary, moveable, craftable, and as affordable as the bulb they are made to display.

The light bulb is merely protected by a body design, rather than enclosed or surrounded. The 'cage' utilizes the enclosed concept. The shade utilizes the surrounded concept. Because the light bulb will be hung high, the protection is 'beneath' and 'above', and the connection between beneath and above is 'alongside'. The connecting pieces, which are pieces #2 and #3, could be of a different material than the unit and socket material, such as a very lightweight, nonbreakable plastic. If the size of the light bulb socket is reduced by a percentage, such as half, quarter, or enlarged twice, then, then the size of the body pieces could be reduced or enlarged by that same percentage.

Historical Prior Art:

This light body design relates to additive mixing, as seen in many display technologies, as opposed to the subtractive color model, which explains the mixing of paints, dyes. etc., to create a range of colors. This topic includes "Industrial Chemistry", and Mr. Michel-Eugène Chevreul, in history, was a man who was a sceptic as to the "scientific" psychical research or spiritualism (early to mid 1800s), a religious movement relating to magic, trances, dissociation. Light is a mixture of wavelengths of various colors and is perceived as colorless, as sunlight. The parts of an incandescent light bulb are the filament, gas, base.

Present Day Research

Converter boxes and analog television sets are related to 'chemiluminescence'. Supporting structural microwaves (taking the white light out of monitors and making that part of a light body) are 'fluorescence and phosphorescence' from fluorescent light bulbs and televisions. The topic is under 'radiation' and 'physics', and involves bandwidth, wavelength, wavefronts (3D). L.E.D.s and Microwave lamp, being created in China, Japan and California: the 'microwave lamp' is being researched at Livermore, Calif., University of California-Berkeley Lab. The U.S. Dept. of Energy is researching this, too, with the Univ. of California system.

Additional Prior Art

At 'Xerox Palo Alto Research Center', in 1972, Mr. Alan Kay published a paper on an item (priced then at $500) he called a 'Dynabook'. This item was owned by 'Apple Computer' and involved radio, later. In 2008, 'Hewlett Packard' is selling the 'Omnibook', a notebook computer, for under $500. Transition—DPI (dots per inch)—technology: differentiates between pixels (on a computer screen—72 DPI) and pics (a good printer—180 DPI). U.S. Pat. No. 4,394,860 is held by Mr. Derrick A. Smith, of Hollywood, Fla., dated Jul. 26, 1983, filed Sep. 26, 1980. In his drawings, solar light bulbs appear large and not a single shape—a bulb and surrounding tubes.

Prior Research Bulb Wattage and Fixture Grouping

Wattage required to properly light a room is equal to the length times the width of a room multiplied by 1.5. For task lighting, the wattage required is equal to the length times the width of a room multiplied by 2.5. Mini-pendants work best in multiples of two, three or more. They should hang about 30 inches from the surface and be spaced about 18 inches apart. Chandeliers should hang 30 inches from the table for 8' ceilings. For every foot over 8' in ceiling height, add 3". For correct chandelier size: add the length and width of the room measured in feet, and the sum equals the ideal diameter measured in inches.

After much study, the design is for a light bulb disposable (short-term convenience, limited amount of use, may last several months, or warranty is for 90 days) body, equal in size and definition to a mini-pendant or chandelier—not designed for a present day designed solar bulb, but, could be used with a Chinese L.E.D. light bulb with a 3 yr. warranty; a spiral fluorescent bulb; a regular 40 watt bulb; a light stick; and/or adapted to other bulb shapes. That's the idea behind the light body design—an adaptable design for the light bulb, which has changed shapes since 1989. The microwave (present day design is invisible to the eye) has no shape. Luminescent paint (a liquid) has no definite shape. The light bulb will continue to change shape, and so, this invention claims all possibilities for the inside material shape where the light bulb will hang. The outside material shape of the bulb protection is basic geometry—triangle, circle and/or square. Basic geometry will hang around whatever the shape is of the light bulb desired to be used.

BRIEF SUMMARY OF THE INVENTION

The design of the inexpensive and portable, hanging light fixture body, or ceiling hung light fixture body, does not include screws or nuts—no need for a screw driver. The six pieces could be built from hard plastic, with the same positive-negative joints and slots, or durable, fire-safe, nonconductive, lightweight, compatible colored metal. So, there exists now the concept of matching light sockets/cord assemblies, already on the market, and new corresponding matching ornamental light bulb body designs. More expensive materials could be used, such as brass or sterling silver, for a specialized product.

Appropriate lighting levels and the effects of different light levels on computer users are subjects of study. Placement of appropriate light around computers, for many people, is a subject of study. The effects of different light placements vary with individuals and their age, weight, and health. The white light bulb in this hanging light fixture body could be of any design or wattage, but small wattage would seem to be safer, since the fixture is moveable. Because small wattage suggests grouping the units, a safe number of electrical outlets in the room in which they are placed would have to exist. Older buildings have a limited number of electrical outlets, and this fact brings up an architectural problem that needs to be addressed—other inventions will help in re-use or adaptation of existing electrical systems that are out-of-date or insufficient. There is currently a product on the market.

While several designs for the lamp body have been shown and described, other designs will now be apparent to those knowledgeable of the subject. It will be understood that the drawings and description are merely for illustrative purposes, and are not intended to limit the scope or spirit of the invention which is defined by the claims.

Figures 1, 2, 3, 4, 5, 6:
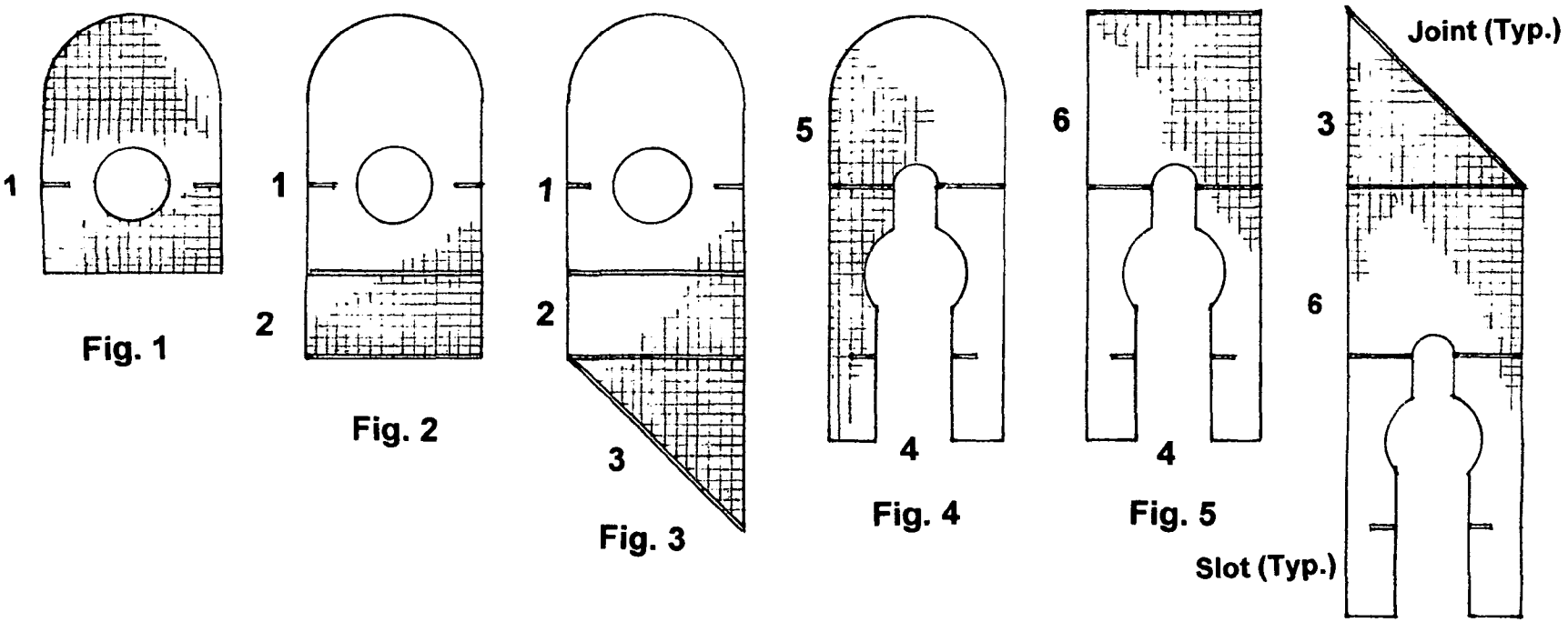
FIG. 1 is for a Single Unit, and is Piece 1
FIG. 2 is for a Double Unit, and is Pieces 1 and 2
FIG. 3 is for a Corner unit, and is Pieces 1, 2 and 3
FIG. 4 is for a Single Unit, and is Pieces 4 and 5
FIG. 5 is for a Double Unit, and is Pieces 4 and 6
FIG. 6 is for a Corner Unit, and is Pieces 3, 4 and 6

The original drawings are covered under 'Lamp Lite Inc.' U.S. Copyright VA 1-132-580, granted May 5, 2001.

MORE COMPLEX units are possible by adding more pieces.

MORE COMPLEX units:

CORNER UNIT+½ CORNER UNIT: (1) of Piece 1, Piece 2, Piece 3, Piece 4, Piece 6.

Units are GROUPABLE.

SINGLE UNIT is GROUPABLE—multiple, for instance five, of the SINGLE UNIT can be hung forming a circular array.

DETAILED DESCRIPTION OF THE INVENTION

Plan Scale: ⅓"=1", or 1"=3".

The middle light bulb hole is 3½" DIAMETER; the light hole is 2½" DIA.; the light hanger hole is 1½" DIAMETER.

The light fixture body is 6" wide.

The unit pieces are either 3", 6" or 9" in length.

A half percentage reduction, for example:

The middle light bulb hole is 1¾" DIAMETER; the light hole is 1¼" DIA.; the light hanger hole is ¾" DIAMETER.

The light fixture body is 3" wide.

The unit pieces are either 1½", 3" or 4½" in length.

The spacing of the metal or aluminum wire depends upon the thickness and weight of the wire.

The outside edges of the pieces, and the joints, are heavier, although still lightweight, bent and/or bendable metal rods.

Pieces #1 and #4 are slotted together forming a tight 90 degree joint. Per National Electrical Code (N.E.C.) 2005 (and latest edition N.E.C. 20011): light bulb is hung by a separately packaged electrical cord attached to a separately packaged electrical socket.

The regular, equal spacing of the metal pieces, and modular, simple shapes of the pieces imply the significance of the open/closed, on/off idea, in the white light lamp fixture body.

Other lamp accessories can be added to the lamp fixture body: "the clapper", which is a hand clapping on/off switch for a tight fixture; the lamp can be plugged into outlets/sockets that will allow the bulb to be dimmed and/or automatically turned on/off; etc.

Some Electrical Code Requirements

"Ceiling" refers to structural ceiling, not hung, dropped, and/or suspended ceilings. A suspended ceiling or fireproof fabric or structure can hold a very lightweight light fixture body.

This lamp fixture body is not meant for a bathroom, laundry room or any wet area.

The light bulb socket wiring can be considered a 'flexible cord or cable'.

The luminaire (lighting fixture), lampholder, or lamp can be classified under 'Lighting Systems Operating at 30 volts or less'.

Wattage recommendation for single light bulb is 40 or 60 watts, maximum.

The simple, inexpensive lamp fixture body is meant for a residence such as a dormitory, and/or short-term and/or fast assembly/pre-assembled primary residential, home office, or commercial office or institutional, such as school, setting.

This light fixture body was not meant for any 'floating building' or any moveable 'recreational vehicles'.

Can be assembled and installed without assistance by one person—no previous electrical knowledge required.

Recommended finish: Platinum, if not painted in a primary color and steel is used.

Some recommended materials:

Aluminum metal wires—lighter weight and easier to bend; steel wire—for the inside of the pieces, w/spacing based upon weight of wire:

16 ga. galvanized wire, for suspended ceilings; 3/32" uncoated galvanized wire rope, plain—0.18/foot.

Aluminum joint rods—lighter weight and easier to bend; steel metal joint rods—more common and stronger and durable, longer lasting:

round rod 1/8 inch×3 foot brass; round rod 1/8 inch×3 foot plain.

Light bulb socket/cord/plug for outlet assembly.

Light bulb: soft white 60 or 40 watt; Halogen 2 yr; 14 watt, mini-spiral 10,000 hr; 9 watt, mini-spiral; Halogen bi-pin base, 35 w max.

Ceiling hanger: Swag Hooks.

Separate light bulb socket: wing nut; cap nut

Porcelain Socket Adapter Kit; Socket.

Adaptor Medium Base Outlet Adaptor, 660 watt max., E26 medium screw base.

Separate cord or cable: #2 decor chain; #4 decor chain; #16 decor chain; 15' Gold Cord Set w/Plug Carded Lamp Part; White Ceiling Fan Swag Kit, for lighting fixtures; 10' Vintage Brass 9 ga. Chain for high ceilings accessory. Separate electrical plug for wall outlet or other accessories: touch control Lamp Dimmer, screw-in; Occupancy Sensor Wall Switch—white. For grouping of fixtures: Stem Kit for cord—hung Mini-Pendant.

For covering of the steel or aluminum or steel and aluminum fixture body: thin white acrylic sheet or lightweight clear plastic sheet cut to size to cover pieces, with wax or glue joint at the edges.

The invention claimed is:

1. An ornamental body for a light comprising a kit having at least one unit, said unit having at least two separate, foldable 2-dimensional pieces with slots and tabs that fit together forming a 3-dimensional shade for said light, said foldable 2-dimensional pieces having different shapes from one another and, at least two of said units being joined together to form a combination shade having at least two lights.

2. The ornamental body of claim 1 wherein said unit comprises three separate, foldable 2-dimensional pieces with slots and tabs that fit together forming a 3-dimensional shade for said light said foldable 2-dimensional pieces having different shapes from one another.

3. The ornamental body of claim 1 wherein said unit comprises seven separate, foldable 2-dimensional pieces with slots and tabs that fit together forming a 3-dimensional shade for said light, some of said foldable 2-dimensional pieces having different shapes from one another and some of the foldable 2-dimensional pieces having the same shape.

* * * * *